United States Patent [19]

McLaren

[11] 4,192,443

[45] Mar. 11, 1980

[54] DIVIDED PAPERBOARD TRAY

[75] Inventor: Edwin C. McLaren, Apple Valley, Minn.

[73] Assignee: Champion International Corporation, Stamford, Conn.

[21] Appl. No.: 922,813

[22] Filed: Jul. 10, 1978

[51] Int. Cl.² ..... B65D 5/48

[52] U.S. Cl. ..... 229/28 R; 229/15; 229/42

[58] Field of Search ..... 229/27, 28, 42, 15

[56] References Cited

U.S. PATENT DOCUMENTS

| | | | |
|---|---|---|---|
| 1,345,711 | 7/1920 | Shapiro | 229/42 |
| 1,475,983 | 12/1923 | Casey | 229/27 |
| 2,205,157 | 6/1940 | Schrell | 229/28 R |
| 2,385,493 | 11/1966 | Coe et al. | 229/15 X |
| 2,964,230 | 12/1960 | Nemoede | 229/28 R X |
| 3,917,155 | 11/1975 | Bemiss | 229/31 R |

*Primary Examiner*—Davis T. Moorhead

*Attorney, Agent, or Firm*—Evelyn M. Sommer

[57] ABSTRACT

A container for packaging frozen food in which the food can be reheated including a paperboard tray having upstanding side walls and horizontal flanges and an upright central divider wall forming separate food compartments in the tray. Each compartment can be subdivided by pivoting a panel cut from the base of the tray transversely of the compartment to an upright position and locking the panel to the central divider wall. A pre-formed, semi-rigid blister of thermoformable plastic material is combined with the paperboard tray to provide a leak proof container.

3 Claims, 8 Drawing Figures

Fig. 3.
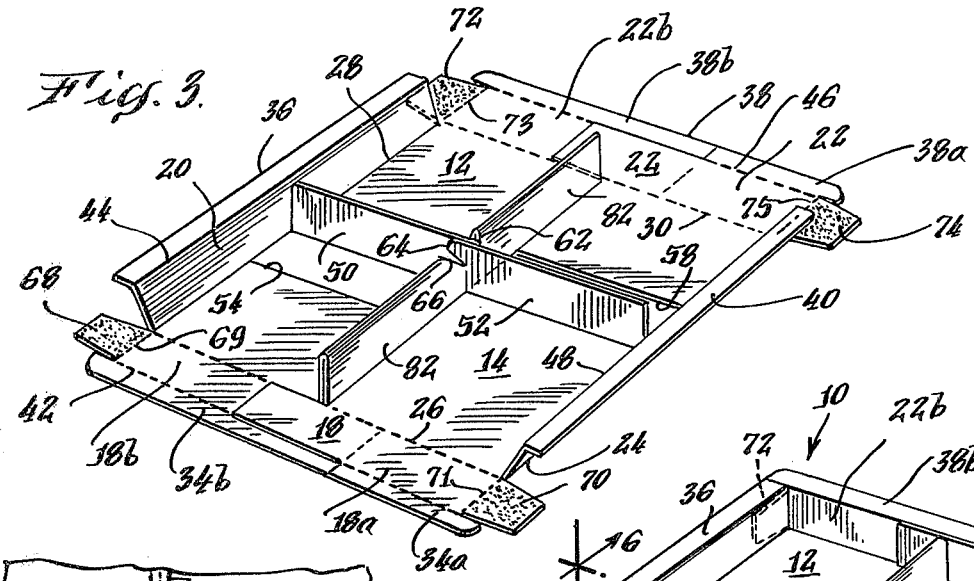
Fig. 4.
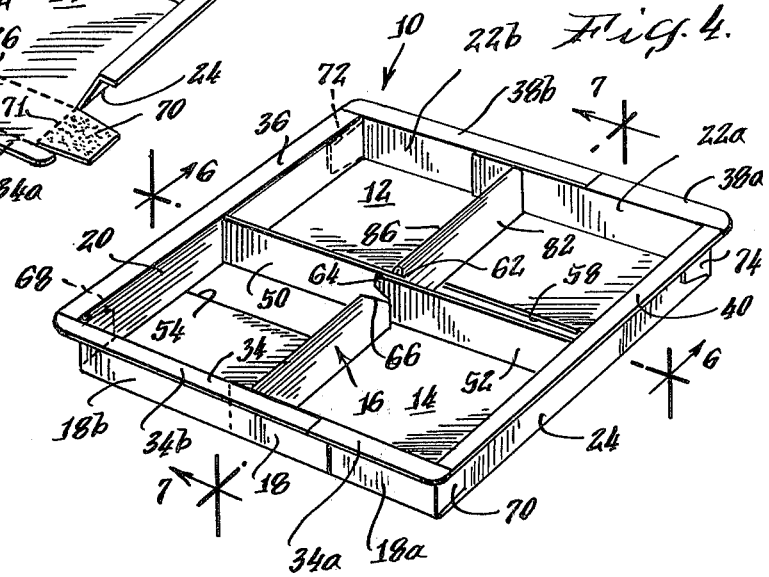
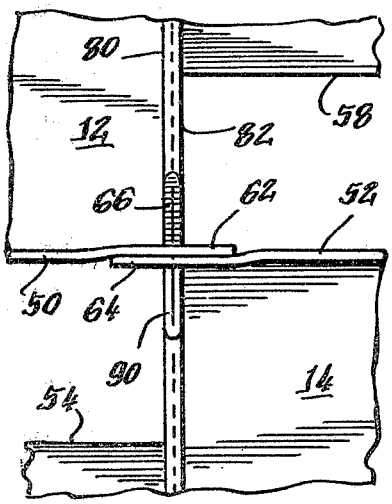
Fig. 5.
Fig. 6.
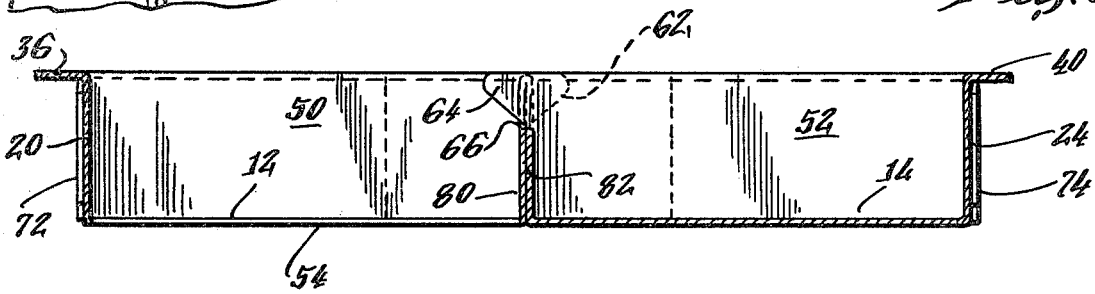
Fig. 7.
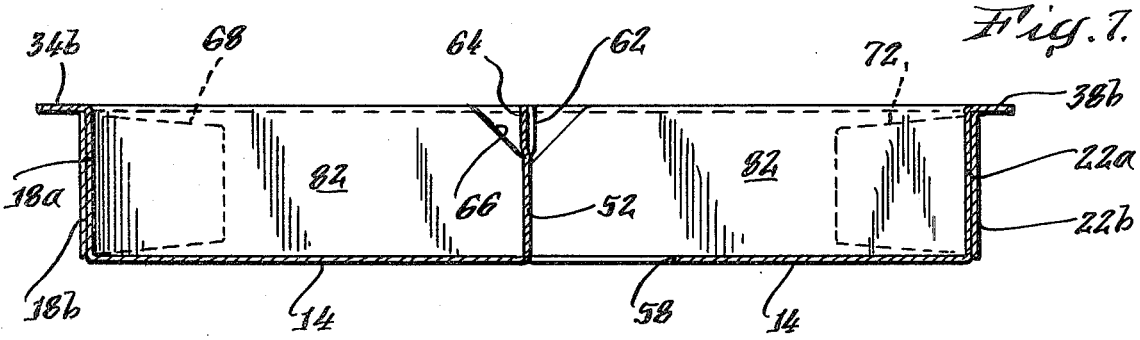

DIVIDED PAPERBOARD TRAY

BACKGROUND OF THE INVENTION

1. Field of the Invention

This invention relates to a container and, more particularly, to a divided food container used for packaging food during refrigeration which may also be used during the subsequent heating and serving of the packaged food.

2. Description of the Prior Art

There is a demand for a container wherein meals consisting of different foods are packaged and refrigerated for a substantial length of time and subsequently prepared and served within a minimum length of time. Such a container is particularly needed for meals which are to be served on airliners and at institutions such as schools and hospitals as well as in homes wherein food may be re-heated in a microwave oven. Separate, premeasured portions of food must be stored in the container under refrigerated conditions for extended periods of time and then quickly reheated and served.

Such a food container must be low in cost, disposable, and adapted to protect the packaged food stored therein under conditions of the extreme temperature variations.

Heretofore, the majority of prior art food containers used for such purposes were made completely from plastic or metal foil. Although metal foil and plastic can be used to form food packaging containers, their use has certain disadvantages. For example, the preferred method at present for reheating premeasured food portions disposed in such containers is through the use of microwave ovens. One advantage of microwave ovens is that the food within the container can be heated without necessarily heating the container in which the food is packaged. Thus, the use of metal foil as the packaging material nullifies this advantage in that a microwave oven will heat both the food and the metal food container, making the container difficult to handle. Additionally, the use of metal food containers tend to short circuit microwave radiation, reducing the effectiveness of the oven.

With regard to food containers constructed solely from plastic materials, the material and manufacturing costs for producing a sufficiently rigid container are higher than the material and manufacturing costs associated with the use of paperboard as a container material. The packaging operation by which the food products are sealed in individual containers should be highly automated and should employ low cost materials to reduce packaging costs without reducing the integrity of the package seal. Paperboard is strong and relatively inexpensive and therefore generally suitable for such packaging applications.

It has been found that if a paperboard food container is lined with a continuous sheet of film, such as polypropylene or polyethylene, the film would tend to rigidify the container and further tends to lock flanges formed on such a container in place, which can be associated with a lid for the container. The film has been formed in place after the container has been erected from a paperboard blank which leads the formation of such containers to low cost, mass produced, manufacturing operations.

U.S. Pat. No. 3,932,105, issued Jan. 13, 1976 and assigned to the assignee of the present invention, discloses equipment and a process for lining an erected paperboard food container with a continuous sheet of film. In a preferred embodiment, the film is heated and then drawn into intimate contact with the interior tray walls by applying a vacuum to the exterior bottom wall and exterior side walls of the tray.

U.S. Pat. No. 3,863,832, issued Feb. 4, 1975, illustrates a paperboard food container of the type discussed above, which might be useful in such a manufacturing process. The food packaging container disclosed therein includes a tray and a lid, both of which are constructed of paperboard having a thermoplastic coating on at least the interior surface thereof. The tray includes a base portion and a plurality of upstanding walls. The base portion is rectangular with four divergently upstanding walls which are foldably connected to the base portion. The upstanding walls are traversely interconnected by corner closures. Each corner is foldably connected to an upstanding wall at one end thereof and is overlappingly bonded to the transverse end of the adjacent upstanding wall. Each of the upstanding walls is foldably connected to a horizontal panel. The ends of the horizontal panels are abutting so as to form a horizontal, peripheral flange. A lid may then be bonded to the peripheral flange to seal food contents placed within the container. In one embodiment, an upstanding central divider wall is provided in the rectangular base portion to provide a pair of discrete compartments for holding different food portions.

SUMMARY OF THE INVENTION

The tray of the present invention is similar to that disclosed in U.S. Pat. No. 3,863,832, except additional compartments are formed for separate food items by subdividing each compartment of the food tray into a subcompartment by die cutting the base portion of the tray on both sides of the central divider wall by a line substantially perpendicular to the central divider wall extending from the central divider wall to an opposed upstanding side wall of the tray. A perforated score line is disposed parallel to each die cut line so that a panel is formed on opposed sides of the upright divider wall which can be lifted from the base into an upright condition to subdivide each compartment on opposite sides of the central divider wall into a pair of individual compartments for holding discrete food items. A V-shaped notch is also provided in the center of the upright central divider wall which receives an ear or tab on the panel to lock the subdividing panels in their upright position on the tray.

A liner used in combination with the paperboard tray described above comprises a pre-formed, semi-rigid blister of thermoformable plastic material. The blister conforms generally to the tray interior and includes flanges which are sealed to the flanges of the paperboard tray.

BRIEF DESCRIPTION OF THE DRAWINGS

Further objects and advantages of the invention will become apparent from the following description and claims, and from the accompanying drawings, wherein:

FIGS. 2 and 3 are perspective views illustrating the folding of the blank of FIG. 1 into a food tray;

FIG. 4 is a perspective view of the erected, divided food tray of the present invention;

FIG. 5 is a partial top plan view of the central portion of the food tray of FIG. 4;

FIG. 6 is a cross-sectional view taken substantially along the plane indicated by line 6—6 of FIG. 4;

FIG. 7 is a cross-sectional view taken substantially along the plane indicated by line 7—7 of FIG. 4.

DETAILED DESCRIPTION OF THE PREFERRED EMBODIMENT

Figure 1:
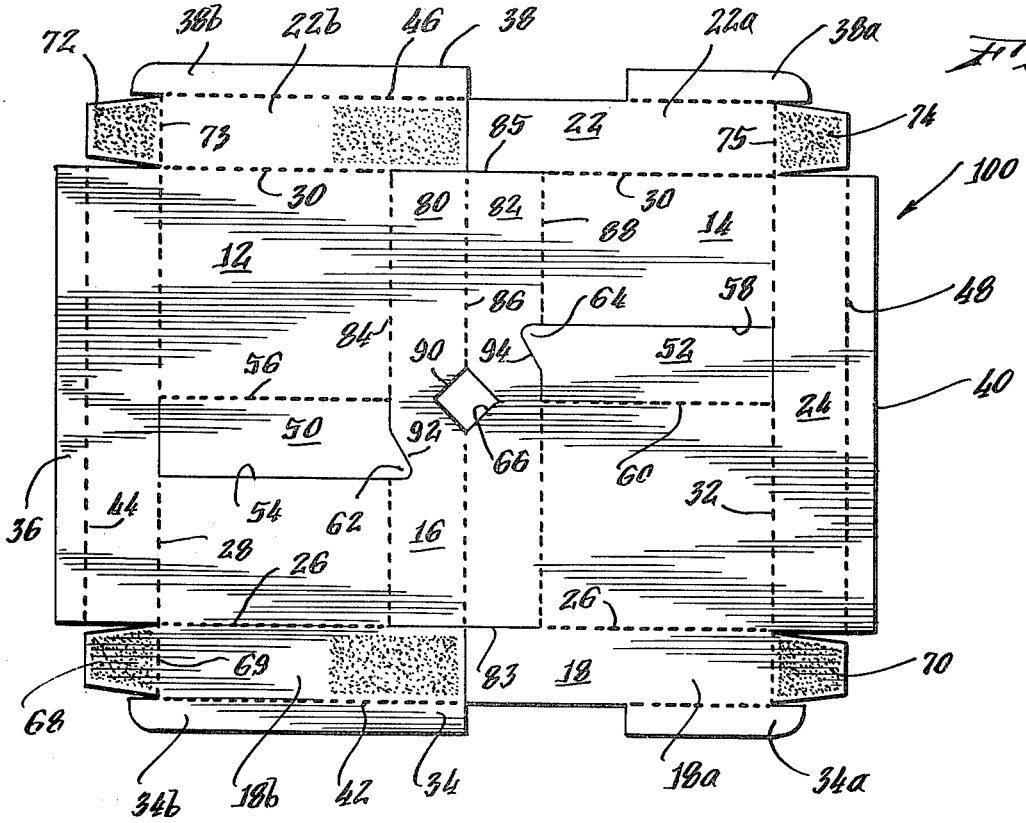
FIG. 1 is a plan view of a blank for forming the divided food tray of the present invention.

Referring now to the drawing in detail, wherein like numerals indicate like elements throughout the several views, the paperboard tray 10 of the present invention includes two rectangular base portions 12 and 14 separated by an upstanding divider wall 16. Wall 16 is of double thickness and extends across the width of the tray 10 to divide the tray into two compartments whose bottoms constitute the base portions 12 and 14.

Upstanding walls 18, 20, 22 and 24 are foldably connected to the base portions 12 and 14 by fold lines 26, 28, 30 and 32, respectively. Horizontal flanges 34, 36, 38 and 40 are foldably connected by perforated score lines 42, 44, 46 and 48, respectively, to the top edges of the upstanding walls 18, 20, 22 and 24. The ends of the flanges 34, 36, 38 and 40 are so shaped so as to abut to define a peripheral horizontal flange all about the tray 10 and can be used to receive a lid for sealing the contents disposed within each of the compartments of the tray.

Each of the compartments of tray 10 can be further subdivided into two individual compartments. In order to accomplish this objective, the base portion 12 includes a rectangular flap 50 cut along a line 54 and hinged by a fold line 56 to the base portion 12. Similarly, a rectangular panel 52 is cut in the base portion 14 along line 58. Panel 52 includes a fold line 60 parallel to the cut line 58 which hingedly connects the panel 52 to the base portion 14. Each of the panels 50 and 52 include a triangular shaped ear 62 and 64, respectively, cut from a portion of the central upright divider wall 16. A V-shaped notch 66 is cut in the vertical divider wall 16. When it is desired to use the panels 50 and 52 to subdivide each of the two compartments in tray 10, the panels are pivoted to an upright position about its respective fold line 56 and 60 and the ears 62 and 64 are disposed in the V-shaped notch in abutting relation with each other. The ear 64 on the panel 52 is disposed closer to its fold line 60 while the ear 62 on the panel 50 is disposed closer to its fold line 56 so that the ears are retained in abutting relationship by the resiliency of the panels or their tendency to return to a flat condition. The ears 62 and 64 serve as an interlock to retain the panels 50 and 52 in an upright condition. The V-shaped notch 66 permits the extension of the ears 62 and 64 through the upright central divider wall 16.

A substantially rectangular tab or corner closure is foldably connected by a fold line 69 to one of the edges of upstanding wall 18. A similar tab 70 is connected by a fold line 71 to the opposite edge of upstanding wall 18. A closure tab 72 is connected by a fold line 73 to one lateral edge of the opposite upstanding side wall 22, while a tab 74 is connected by a fold line 75 to the opposite lateral edge of upstanding wall 22. The tabs 70 and 74 are rotated 90 degrees about their respective score lines 71 and 75 and adhesively secured to the outer surface of upstanding wall 24. Similarly, the tabs 68 and 72 are rotated 90 degrees about their respective fold lines 69 and 73 and adhesively connected to the exterior surface of the upstanding wall 20 to maintain the tray 10 in its erected state.

As shown in FIG. 1, the tray 10 is formed from an integral, one-piece blank 100. The blank 100 includes the rectangular base portion panel 12 connected to the rectangular base portion panel 14 by the rectangular central divider panel 16. Panel 16 consists of a pair of rectangular panels 80 and 82 having die-cut lateral edges 83 and 85. The panel 81 has its top edge or left-hand edge defined by a perforated score line 84 foldably connected to the bottom edge of base portion panel 12. The second panel 82 of the upright divider wall 16 has its upper or left-hand edge connected by a fold line 86 to the lower or right-hand edge of the panel 80 and its lower edge defined by a perforated score line 88 which connects it to the top or left-hand edge of the second base portion panel 14. The V-shaped notch 66 is formed by die cutting a diamond shaped opening 90 between the panels 80 and 82.

The subdivider panels 50 and 52 are formed by die cutting them along lines 54 and 58 in their respective base portion panels 12 and 14. The ear 62 connected to subdivider panel 50 is die cut along a triangular line 92 in panel 80 while the ear 64 is die cut in panel 82 along a triangular line 94.

The top or left-hand foldable edge 28 of the first base portion panel 12 is connected to a rectangular panel 20 forming one of the upstanding walls defining the tray 10. Similarly, the lower or right-hand foldable edge 32 of the second base portion panel 14 is connected to rectangular panel 24 forming the opposite upstanding wall. The top edge of panel 20 constitutes the perforated fold line 44 connected to flange panel 36 while the top edge of wall 24 constitutes the perforated score line 48 connected to the flange portion 40. However, the upstanding walls 18 and 22 are formed from two overlapping wall panels 18*a* and 18*b*, while the upright wall 22 is similarly formed from overlapping panels 22*a* and 22*b*.

Panel 18*a* is connected by the lower portion of a discontinuous fold line 26 (interrupted by die-cut edge 83) to the lefthand lateral edge of lower base portion panel 14. Panel 18*b* is connected by a separate, spaced portion of fold line 26 which continues along the left-hand lateral edge of upper base portion panel 12 to upper base portion panel 12. Similarly, the right-hand fold line 30 is discontinuous, being interrupted by die-cut edge 85. An upper portion of the fold line 30 constitutes the right-hand lateral edge of upper base portion panel 12 and connects the panel 22*b* to upper base portion panel 12. A lower portion of the fold line 30 forms the right-hand lateral edge of the lower base portion panel 14 and connects the panel 22*a* to the lower base portion panel 14. The flanges 34 and 38 are also discontinuous and constitute lower sections 34*a* and 38*a* and upper sections 34*b* and 38*b*. Perforated lines 42 and 46 are discontinuous and an upper portion of line 42 connects the panel 34*b* to the top edge of panel 18*b* while an upper portion of the perforated score line 46 connects panel 38*b* to panel 22*b*. The lower portion of the perforated score lines 42 and 46, respectively, connect the upper edge of the panels 18*a* and 22*a*, respectively, to the discontinuous flange portions 34*a* and 38*a*, respectively.

Figure 2:
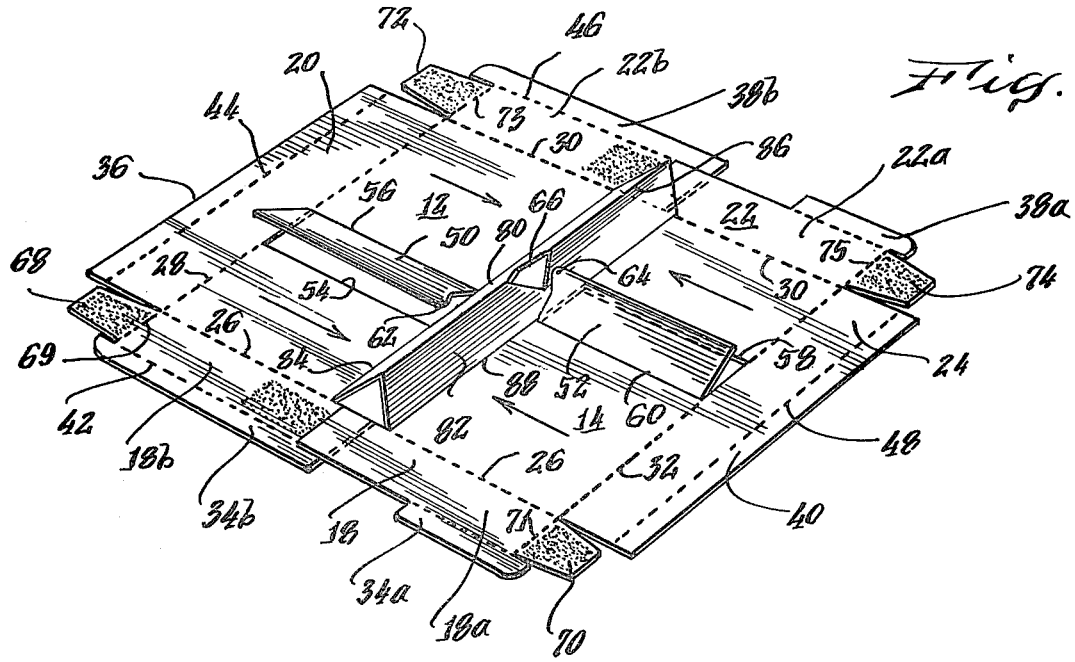

In erecting blank 100 into tray 10, as shown in FIGS. 2 and 3, the central divider wall 16 is first formed by abutting the outer surfaces of panels 80 and 82 by folding the panels into abutting relation about fold line 86, as indicated by the arrows in FIG. 2. Panel 22*a* is then overlapped with panel 22*b* and adhesively secured thereto. Similarly, panel 18*a* is overlapped with panel 18*b* and adhesively connected thereto. It will be noted that flange portion 34*a* has its upper edge in abutment with the lower edge of flange portion 34*b* while flange portion 38*a* has its upper edge placed in abutment with the lower edge of flange portion 38*b* (FIG. 3). The walls 18, 20, 22 and 24 can then be disposed in an upright condition by folding them about their respective score lines 26, 28, 30 and 32, respectively. Corner closure tabs 68, 70, 72 and 74 are then folded into abutment with the adjacent upright walls 20 and 24 and adhesively secured thereto.

If it is desired to subdivide the compartments on either side of the upright central divider wall 16, panels 50 and 52 are rotated to an upright condition about their respective fold lines 56 and 60 and the ears 62 and 64 interlocked within V-shaped notch 66.

Figure 8:
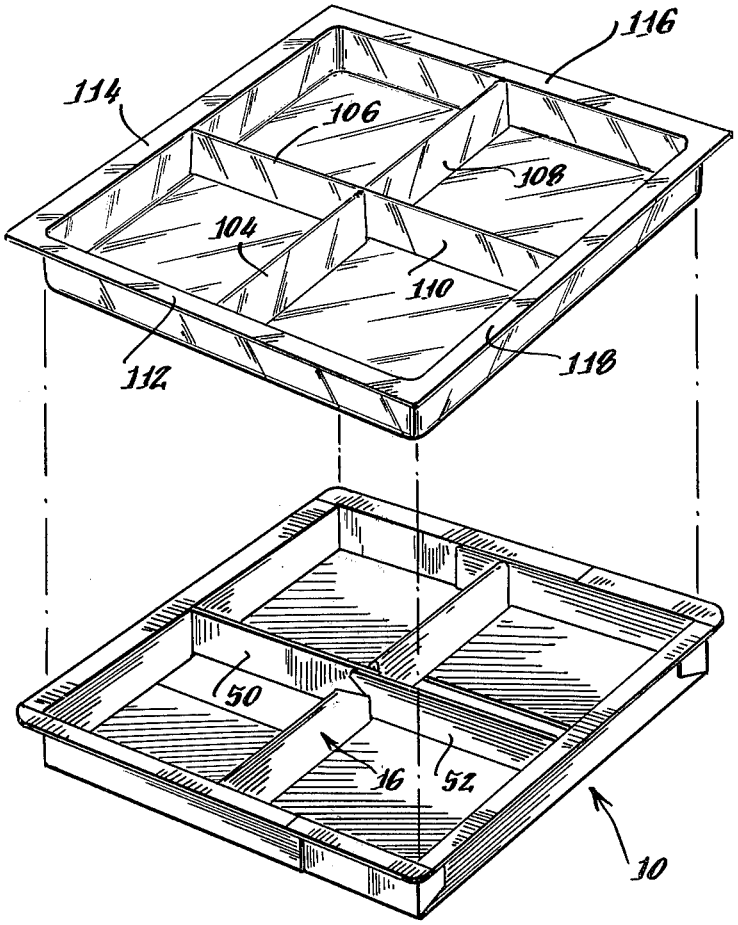
FIG. 8 is an exploded view showing the fully erected divided food tray and its pre-formed liner.

Referring now to FIG. 8, the paperboard tray 10 described with reference to the foregoing FIGURES, is used in combination with a leakproof liner 102 shown in an exploded view for purpose of clarity. Liner 102 is a pre-formed, semi-rigid blister of thermoformable plastic material and generally conforms to the interior of tray 10. More specifically liner 102 is crossed by integral, inverted V-shaped divider walls 104, 106, 108, 110 which fit over the tray dividing members 16, 50, and 52. Liner 102 has flanges 112, 114, 116 and 118 which rest on and are bonded to corresponding flanges on tray 10 by means of a suitable adhesive or by a heat sealing technique. Liner 102 may also optionally be sealed to the floor of the tray at one or more of the tray compartments. The paperboard tray is rigid enough to permit liner 102 to be semi-rigid in construction, rather than completely rigid and self-supporting. This reduces the cost of the container combination relative to the cost of an all plastic container.

The line 102 conforms generally but not exactly to the interior of the tray. The edges and corners of the liner are more rounded than the corresponding edges and corners of the tray to avoid tray areas in which food would be overheated due to microwave radiation impinging from different directions.

What is claimed as new is as follows:

1. A compartmentalized container for packaging, storing and heating foods comprising:

a paperboard tray including a horizontal base portion having a central divider wall extending upwardly therefrom substantially perpendicular thereto to form a pair of discrete food compartments on said base portion, a plurality of upstanding walls foldably connected to said base portion, a corner closure foldably connected to selected ones of said upstanding walls overlapping an adjacent upstanding wall and being connected thereto, a horizontally disposed flange foldably connected to the top edge of each of said upstanding walls, each of said flanges abutting each other at their ends to form a peripheral flange, a subdivider wall pivotally connected to said horizontal base portion along a fold line to move from a flat to an upright position transversely within each of said discrete food compartments, means for interlocking said subdivider walls in an upright position, said interlocking means including a substantially V-shaped notch cut in the top of said central divider wall and an ear extending from one edge of each of said subdivider walls in abutment with each other in said V-shaped notch, said plurality of upstanding walls including a first pair of opposed, upstanding walls, and a second pair of opposed, upstanding walls, the base portion of said tray being divided into a first and second portion by said central divider wall, the first of said base portions being foldably connected to one of said first pair of said opposed upstanding walls and both of said second pair of opposed upstanding walls, the second of said base portions being foldably connected to the other of said first pair of said opposed upstanding walls and both of said second pair of opposed upstanding walls, said central divider wall being formed by three parallel fold lines between said first and second portions of said base defining two panels folded about said fold lines into abutting back-to-back relation; and a leak proof liner for said paperboard tray comprising a preformed, semi-rigid blister of thermoformable material conforming generally to the interior of said paperboard tray, said blister being sealed to said tray at the flanges.

2. The container of claim 1 wherein said corner closures of said tray include a tab foldably connected to opposed edges of each of said first pair of upstanding walls, and a tab on each of said first pair of upstanding walls being adhesively connected to a surface of each of said upstanding walls of said second pair of upstanding walls.

3. The container of claim 1 wherein at least the exterior of said tray is coated with a thermoplastic material.

* * * * *